United States Patent [19]

Lippmann et al.

[11] 4,438,307

[45] Mar. 20, 1984

[54] ELECTRIC VACUUM SWITCH

[75] Inventors: Hans-Joachim Lippmann; Gerhard Peche; Hans Bettge, all of Berlin, Fed. Rep. of Germany

[73] Assignee: Siemens Aktiengesellschaft, Berlin & Munich, Fed. Rep. of Germany

[21] Appl. No.: 480,899

[22] Filed: Mar. 31, 1983

Related U.S. Application Data

[63] Continuation of Ser. No. 111,668, Jan. 14, 1980, which is a continuation of Ser. No. 820,796, Aug. 1, 1977.

[30] Foreign Application Priority Data

Aug. 27, 1976 [DE] Fed. Rep. of Germany ..... 2638700

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,818,163 | 6/1974 | Robinson | 200/144 B |
| 3,953,698 | 4/1976 | Luttgert et al. | 200/144 B |

FOREIGN PATENT DOCUMENTS

| | | | |
|---|---|---|---|
| 1196751 | 3/1966 | Fed. Rep. of Germany | 200/144 B |
| 1765263 | 3/1976 | Fed. Rep. of Germany | 200/144 B |
| 2557174 | 7/1976 | Fed. Rep. of Germany | 200/144 B |

*Primary Examiner*—Robert S. Macon

*Attorney, Agent, or Firm*—Hill, Van Santen, Steadman & Simpson

[57] ABSTRACT

The invention relates to a vacuum switch with cup-shaped switch contact components having an obliquely slit contact carrier and mounted unslit contact ring. The contact carrier consists of copper with or without additional chromium and the contact ring consists of a chromium-copper matrix with or without additions. The electrical conductivity changes rapidly from the contact carrier to the contact ring by a factor of at least 3. The invention is useful for high power vacuum switches.

8 Claims, 3 Drawing Figures

ELECTRIC VACUUM SWITCH

This is a continuation of application Ser. No. 111,668, filed Jan. 14, 1980 which was a continuation of Ser. No. 820,796 filed Aug. 1, 1977.

BACKGROUND OF THE INVENTION

1. Field of the Invention

The invention relates to an electric vacuum switch with two cup-shaped switching contact components which are composed of electrically conductive material and each consisting of a contact carrier having a base and having a cylinder jacket-shaped wall. A contact ring having a ring-shaped contact surface is placed onto the wall at the end side facing away from the base. The wall is divided into segments by radial slots running obliquely to the contact component axis.

2. Description of the Prior Art

An electric vacuum switch of this type is known and described, for example, in German Pat. No. 1 196 751, in which a switching tube for high contact ratings is disclosed which, in particular, must exhibit a high short-circuiting disconnect capability. In order to effect the disconnection, the contact surfaces, arranged one above another, of the two cup-shaped contact components are mechanically separated from one another, thus producing an arc consisting of ionized metal vapor. In order to prevent the destruction of the contact surfaces, the arc is to move rapidly across the contact surfaces. For this purpose, by bending the current path, a resultant magnetic field is produced at right angles to the current direction and deflects the arc current in a third, perpendicular direction and causes it to rotate. This is achieved by means of oblique slotting of the contact components. The contact carriers are thus at least partially divided into individual segments.

When high currents are disconnected, the contact components are also subject to mechanical load. In order to provide the contact components with a greater stability, the German Pat. No. 1 196 751 proposes that the slotting of the contact components should not extend to the contact surfaces. This produces continuous contact rings. This also has the advantage that the rotation of the arc is not disturbed by breaks in the contact surfaces, and that there is relatively no heavy erosion of the contact material in the region of the slots.

For the same purpose it is known from German AS No. 17 65 263 to surround the obliquely slotted contact components with a casing body consisting of high-grade contact material at least on the contact surfaces and the laterally adjoining surfaces of the contact components. The mechanical stability and the arc rotation are provided by the slotted core of the contact components. The favorable erosion characteristic is insured by the continuous casing body which can be relatively thin and thus permits an economical use of high-grade contact material.

Suitable contact materials are those which have been purified in a zone melting process. It is necessary to use materials of this type to insure that during the disconnection process, gases are released from the contact material in addition to the metal which has been vaporized by the arc. Gases of this kind would impair the high vacuum and promote a re-ignition of the arc.

SUMMARY OF THE INVENTION

An object of the present invention is to design the contact components in a vacuum switch in such manner that on the one hand by shaping and on the other hand by means of material composition a favorable compromise is reached between a guaranteed contact rating with a long life duration and the necessary expense. The rotation of the arc is to be insured, the burning or re-ignition of the arc is to be prevented once it has been extinguished. The mechanical stability of the contact components must be insured. The power loss when the contacts are closed is to be as low as possible. Furthermore, there is to be a sufficient safeguard against welding of the contact surfaces.

In an electric vacuum switch of the type described above, it is proposed in accordance with the invention that the electrical conductivity should reduce at least by a factor of 3 at the junction from contact carrier to contact ring.

Beginning with the fundamental feature of the conductivity change along the current path in the contact components, in an advantageous design it is proposed that the contact carriers should consist of pure copper or copper to which up to 1% chrome has been added, and that the contact rings should consist of a chrome matrix with a copper impregnation with or without iron additions of up to 15% and/or cobalt additins of up to 20%.

It is also advantageous if the oblique slots in the walls of the contact components extend into the base. In this case they can extend in the base to the central current supply pin to which the contact components are secured. This improves the current distribution.

The slots in the contact carriers approach the bottom of the contact surface as closely as possible, i.e. the contact rings can be thin in relation to the height of the contact carrier walls. This has a favorable influence on the rotation reliability and reduces cost. The lower limit of the thickness of the contact rings is governed by the requisite mechanical stability of the contact rings in the case of contact components closed under contact pressure, and by the quantity of erosion material required for a requisite life duration.

DESCRIPTION OF THE PREFERRED EMBODIMENTS

Figure 1:
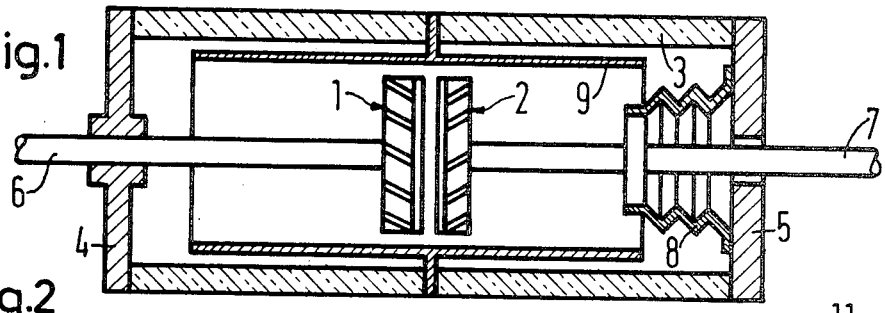
FIG. 1 is a longitudinal section through a schematically illustrated vacuum switch corresponding to the invention.

The vacuum switch schematically illustrated in FIG. 1 has an evacuated housing which consists of a cylindrical insulating body 3 composed of glass or ceramic, and of two metallic end plates 4 and 5 which seal the end sides of the insulating body 3 in vacuum-tight fashion. Without this vacuum-tight housing, two separable contact components 1, 2 are arranged opposite one another, one being secured to a stationary, solid current supply pin 6 and the other being secured to a mobile, solid current supply pin 7. The current supply pins 6, 7 serve to supply the current and to mechanically guide the contact components 1, 2. The mobile current supply pin 7 is connected to a metal bellows 8, which hermetically seals the vacuum switch between the mobile current supply pin 7 and the end plate 5. Normally a screen 9 is provided in vacuum switches in order to protect the insulating body 3 from the precipitation of metal particles which can evaporate or be torn away from the contact components (1, 2) during the disconnection.

Figure 2:
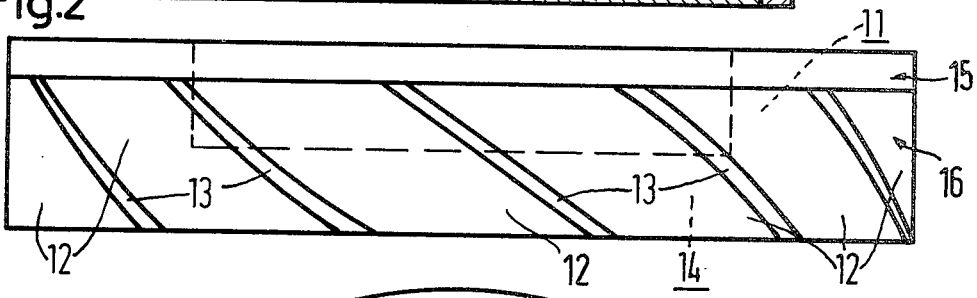
FIG. 2 is an enlarged side view of a contact component.
Figure 3:
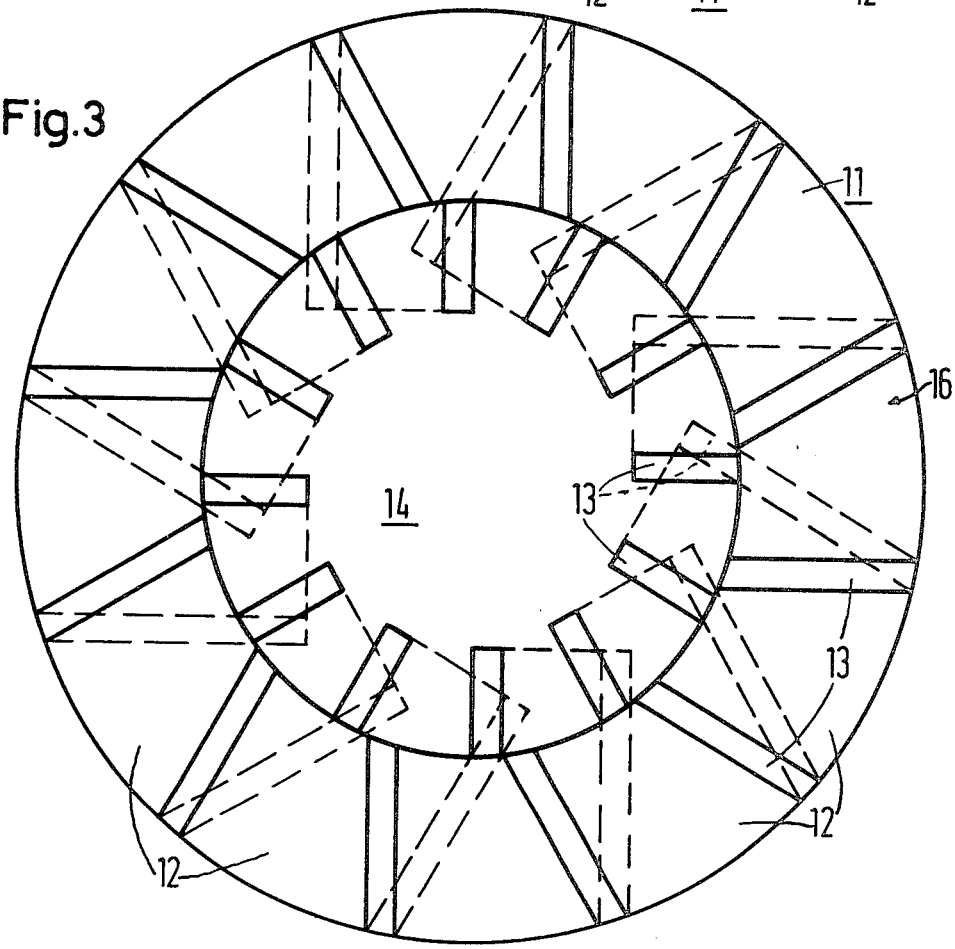
FIG. 3 is a plan view of the contact component shown in FIG. 2 without a contact ring.

The structure for the two symmetrical contact components 1, 2 can be most clearly seen in the enlarged side view of FIG. 2 and the enlarged plan view in FIG. 3 of the contact component 2. The contact component 2 consists of a metallic contact carrier 16 and a thin, metallic contact ring 15 which has been omitted from FIG. 3 for clarity. The contact carrier 16 is cup-shaped and possesses a base 14 and a cylinder jacket-shaped wall 11. The wall 11 is divided into segments 12 by radial slots 13 which run obliquely to the axis. The contact component 2 possesses a slot which is symmetrical to that of the contact component 1. This symmetry is two-fold. On the one hand in the view along the central contact component axis the inclination of the slots 13 towards the axis differs in the two opposing contact components 1, 2 (as can be seen from FIG. 1). On the other hand in the plan view of the two contact surfaces (for the contact component 2 with removed contact ring in FIG. 3), the slots 13 run in a rotary direction around the axis relative to the radii as portions of secants, and in fact in different directions of rotation in the two contact components 1, 2 so that when the contact components 1, 2 are placed one upon another the slots 13 come to lie upon one another on their contact surfaces in their entire length.

As can be seen from FIG. 3, the slots 13 extend into the base 14.

The contact ring 15 consists of a contact material which exhibits an electric conductivity which is lower than that of the material of the contact carrier at least by the factor 3. Preferably the conductivity changes suddenly at the junction point from contact carrier 16 to contact ring 15. This is achieved by hard soldering the contact ring 15 onto the current carrier 16. The solder can be in the form of a silver-copper eutectic, the silver component of which possesses a relatively high vapor pressure.

In this exemplary embodiment6, the contact carrier 16 consists of copper to which up to 1% chrome has been added. The contact ring 15 consists of a chrome matrix which is impregnated with copper to which up to 1% chrome has been added.

The slots 13 can be produced, for example, by sawing the contact carrier 16 with a circular saw.

It is advantageous if the solder layer is arranged as deep as possible, possibly upon the base 14. Them it is possible to virtually eliminate the influence of the silver vapor upon the arc. The cylinder jacket-shaped wall 11 is then formed such that during the impregnation of the chrome matrix metal of the contact ring 15 with the copper impregnating metal, the wall 11 is at least partially simultaneously formed from the copper saturating metal. The connection between contact 15 and wall 11 thus takes place by itself. The connection between the wall 11 and the base 14 is then effected by soldering copper onto copper. This type of soldering is easier to effect than the soldering of the contact ring 15 consisting of chrome-copper onto copper or onto the material of the wall 11. A so-called back casting of the contact ring 15, wherein the wall 11 or at least that part of the wall 11 facing towards the contact ring 15 is formed as a back casting from the saturating metal of the contact ring 15, thus has the advantage of simpler soldering and a deeper-seated solder layer. The impregnation and backing can possibly also be carried out with the chrome additive forming up to 1% of the contact carrier material.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. An electric vacuum switch comprising in combination: two cup-shaped switching contact components comprising electrically conductive material and which each have a contact carrier with a base and a cylindrical jacket-shaped wall and having a wall at an end side facing away from the base; a contact ring which is placed onto the wall at the end side facing away from the base and which has a ring-shaped contact surface; the cylindrical wall being divided up into segments by means of radial slots running obliquely to a central axis of said contact components; the electrical conductivity being suddenly reduced at least by a factor of 3 at the junction from said contact carrier to said contact ring by providing the ring with a contact material which has an electrical conductivity lower than that of the carrier at least by the factor 3; said contact carrier comprising primarily copper and the contact ring comprising a chrome matrix with an impregnation metal primarily comprised of copper; at least upper portions of the jacket-shaped cylindrical wall being formed of said impregnation metal and being joined to said contact ring by a back casting of the impregnation metal of the contact ring onto said upper portions, and at least said upper portions of the wall being soldered by a solder layer onto remaining portions of the contact carrier such that said solder layer is arranged deep and away from the contact ring whereby influencing of solder vapor upon the arc is minimized.

2. A vacuum switch as claimed in claim 1 in which the contact carriers comprise pure copper and the contact rings comprise a chrome matrix with an impregnation material of copper.

3. A vacuum switch as claimed in claim 1 in which the slots in the walls extend into the bases of the contact components.

4. A vacuum switch as claimed in claim 1 in which the contact carriers comprise copper to whch up to 1% chrome has been added, and the contact rings comprise a chrome matrix with an impregnation material of copper.

5. A vacuum switch as claimed in claim 4 in which said impregnation material includes iron additions of up to 15%.

6. A vacuum switch as claimed in claim 5 in which said impregnation material further includes cobalt additions of up to 20%.

7. A vacuum switch as claimed in claim 4 in which said impregnation material includes cobalt additions of up to 20%.

8. An electric vacuum switch comprising in combination: two cup-shaped switching contact components comprising electrically conductive material and which each have a contact carrier with a base and cylindrical jacket-shaped wall and having a wall at an end side facing away from the base; a contact ring which is placed onto the wall at the end side and which has a ring-shaped contact surface having a radial width equal to the end side wall; the cylindrical wall being divided up into segments by means of radial slots running obliquely to a central axis of said contact components; the electrical conductivity being suddenly reduced at least by a factor of 3 at the junction from said contact carrier to said contact ring by providing the ring with a contact material which has an electrical conductivity lower than that of the carrier at least by the factor 3, said contact carrier comprising primarily copper and the contact ring comprising a chrome matrix with an impregnation metal primarily comprised of copper; at least upper portions of the jacket-shaped cylindrical wall being formed of said impregnation metal and being joined to said contact ring by a back casting of the impregnation metal of the contact ring onto said upper portions, and at least said upper portions of the wall being soldered by a solder layer onto remaining portions of the contact carrier such that said solder layer is arranged deep and away from the contact ring whereby influencing of solder vapor upon the arc is minimized.

* * * * *